US011035306B2

(12) United States Patent
Boehm et al.

(10) Patent No.: US 11,035,306 B2
(45) Date of Patent: Jun. 15, 2021

(54) ACTIVATION RESPONSE OF INJECTORS OF AN INTERNAL COMBUSTION ENGINE

(71) Applicant: Bayerische Motoren Werke Aktiengesellschaft, Munich (DE)

(72) Inventors: Martin Boehm, Poecking (DE); Stefan Detterbeck, Munich (DE); Bjoern Hussmann, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/770,383

(22) PCT Filed: Dec. 5, 2018

(86) PCT No.: PCT/DE2018/100992
§ 371 (c)(1),
(2) Date: Jun. 5, 2020

(87) PCT Pub. No.: WO2019/110055
PCT Pub. Date: Jun. 13, 2019

(65) Prior Publication Data

US 2020/0386174 A1 Dec. 10, 2020

(30) Foreign Application Priority Data

Dec. 7, 2017 (DE) ..... 10 2017 222 170.4

(51) Int. Cl.
*F02D 41/00* (2006.01)
*F02M 25/028* (2006.01)
(Continued)

(52) U.S. Cl.
CPC ..... *F02D 41/0025* (2013.01); *F02M 25/028* (2013.01); *F02D 2041/001* (2013.01);
(Continued)

(58) Field of Classification Search
CPC ..... F02D 2200/0602; F02D 2041/001; F02D 41/0025; F02M 25/028
See application file for complete search history.

(56) References Cited

U.S. PATENT DOCUMENTS

| | | | | |
|---|---|---|---|---|
| 3,983,882 | A | 10/1976 | Billings | |
| 4,351,289 | A | 9/1982 | Renda | |
| 2008/0185865 | A1* | 8/2008 | Matsuo | B62J 17/04 296/78.1 |

FOREIGN PATENT DOCUMENTS

| | | | |
|---|---|---|---|
| DE | 10 2016 200 694 | A1 | 7/2017 |
| DE | 10 2016 015 083 | A1 | 6/2018 |

(Continued)

OTHER PUBLICATIONS

International Search Report (PCT/ISA/210) issued in PCT Application No. PCT/DE2018/100992 dated Mar. 11, 2019 with English translation (five (5) pages).

(Continued)

*Primary Examiner* — Kevin A Lathers
(74) *Attorney, Agent, or Firm* — Crowell & Moring LLP

(57) ABSTRACT

A control device is provided for a cooling liquid injection system for an internal combustion engine of a motor vehicle. The cooling liquid injection system includes at least two activatable injectors for introducing a cooling liquid into the internal combustion engine, which injectors can be controlled by the control device. The injectors can be supplied with cooling liquid by way of a common rail, and the control device is designed to receive an inclination variable, which characterizes an inclination of the rail, to determine an activation response for the injectors in dependence on the inclination variable, and to activate the injectors using the determined activation response in order to empty or fill the rail.

12 Claims, 3 Drawing Sheets

(51) Int. Cl.
*F02M 25/022* (2006.01)
*F02M 25/03* (2006.01)

(52) U.S. Cl.
CPC . *F02D 2200/0602* (2013.01); *F02M 25/0227* (2013.01); *F02M 25/03* (2013.01)

(56) References Cited

FOREIGN PATENT DOCUMENTS

| | | | |
|---|---|---|---|
| EP | 2 778 381 | A2 | 9/2014 |
| EP | 3 018 331 | A1 | 5/2016 |
| WO | WO 2016/177497 | A1 | 11/2016 |
| WO | WO 2016/177561 | A1 | 11/2016 |

OTHER PUBLICATIONS

German-language Written Opinion (PCT/ISA/237) issued in PCT Application No. PCT/DE2018/100992 dated Mar. 11, 2019 (seven (7) pages).
German-language Search Report issued in German Application No. 10 2017 222 170.4 dated Sep. 17, 2018 with partial English translation (10 pages).

* cited by examiner

ACTIVATION RESPONSE OF INJECTORS OF AN INTERNAL COMBUSTION ENGINE

BACKGROUND AND SUMMARY OF THE INVENTION

The invention relates to a control device, a coolant injection system and to a method for determining an activation response of injectors of an internal combustion engine.

It is known to increase the power of an internal combustion engine by cooling the internal combustion engine by introducing a coolant. In this context, for example distilled water is used as the coolant. In order to avoid damage to the internal combustion engine due to the introduced coolant, it is advantageous to introduce the coolant exclusively into the internal combustion engine when it is being operated and as a result heated. After the engine finishes operating, coolant remaining in the internal combustion engine can be removed again. In order to fill and empty the internal combustion engine with coolant it is necessary to activate the injectors.

An object of the invention is to provide an improved control device, a coolant injection system and a method for activating the injectors.

The object is achieved by means of the features of the independent patent claims. Advantageous embodiments are described in the dependent claims. It is to be noted that additional features of a patent claim which is dependent on an independent patent claim can form, without the features of the independent patent claim or only in combination with a subset of the features of the independent patent claim, a separate invention which is independent of the combination of all the features of the independent patent claim and which can be made the subject matter of an independent claim, of a partial application or of a subsequent application. This applies in the same way to technical teachings which are described in the description and which can form an invention which is independent of the features of the independent patent claims.

A first aspect of the invention relates to a control device for a coolant injection system for an internal combustion engine of a motor vehicle. The coolant can be, for example, (distilled) water or a water/alcohol mixture.

The injection of coolant is a method for increasing the power of internal combustion engines. In order to avoid exceeding the maximum permissible exhaust gas temperature in the case of high power, coolant is injected into the internal combustion engine. The vaporizing fluid has a cooling effect on the mixture during and after the combustion. Injection is also carried out during the combustion cycle in order to generate steam power and to reduce the exhaust gas temperature.

The coolant injection system comprises at least two activatable injectors which can be controlled by the control device and have the purpose of introducing a coolant into the internal combustion engine, wherein the activation of the injectors is in particular opening or closing of the injectors.

The coolant can be introduced at various locations of the internal combustion engine by means of various methods. In particular, the coolant can be introduced into the internal combustion engine on the inlet side, for example the coolant can be injected into the air intake section. Alternatively, the coolant can also be injected directly into the combustion chamber.

The injectors can be supplied with coolant by means of a common rail, which serves as a pressure accumulator. The rail can be here, for example, actually a common distributor pipe corresponding to the term. In particular, however, it can instead be a pressure accumulator of any desired geometric shape, which is connected to the injectors.

Furthermore, the control device is configured to receive or determine an inclination variable which is characteristic of an inclination of the rail.

The variable which is characteristic of the inclination of the rail can be, in particular, a variable which is characteristic of the inclination of the internal combustion engine or of the inclination of the motor vehicle. The variable which is characteristic of the inclination of the rail can specify here, for example, the inclination in the longitudinal direction of the vehicle about the rolling axis and/or the inclination in the transverse direction of the vehicle about the pitching axis.

The inclination variable can be, in particular, at least one sensor signal, such as for example a signal of a unidimensional or multidimensional inclination sensor or position sensor.

The control device is configured to determine an activation response of the injectors as a function of the inclination variable. The activation response comprises, in particular, the activation sequence in which the injectors are activated, and the activation time of the individual injectors.

The injectors are activated by the control device in order to empty or fill the rail with the determined activation response.

In one advantageous embodiment, the control device is configured to select the activation response for the injectors from a set of at least two predetermined activation responses for the injectors as a function of the inclination variable.

For example, in the case of a first value of the inclination variable which is characteristic of a first, low inclination of the rail, a first activation response can be selected. Alternatively, in the case of a second value of the inclination variable which is characteristic of an inclination of the rail which is greater in comparison with the first inclination, a second activation response can be selected.

The predetermined activation response can differ, in particular, in the activation sequence and/or the activation time of the injectors.

The predetermined activation responses can be determined empirically, in particular during the development of the control device, and can be held ready in a memory module of the control device.

The invention is based here on the realization that a high-quality activation response can comprise various properties. An activation response which is as high as possible in quality can depend here, inter alia, to a very great extent on the geometric structure of the rail, for which reason, for example, a purely analytical determination of the activation response can be very costly.

In a further advantageous embodiment, the control device is configured to determine the activation response for the injectors for a filling process as a function of the inclination variable in such a way that a first injector which is located at a relatively high point owing to the inclination is activated earlier when the rail is emptied than a second injector which is located at a relatively low point with respect thereto owing to the inclination.

In particular, when the coolant injection system is filled, the first injector can be activated earlier than the second injector. Alternatively or additionally, when the coolant injection system is emptied the first injector can be activated earlier than the second injector. The activation of the injectors can be here, for example, opening or closing of the injectors.

As an alternative to this, the control device can be configured to determine the activation response for the injectors as a function of the inclination variable in such a way that a first injector which is located at a relatively high point owing to the inclination is activated later when the rail is filled than a second injector which is located at a relatively low point with respect thereto owing to the inclination.

In particular, here the first injector can be activated later when the coolant injection system is filled than the second injector. Alternatively or additionally, when the coolant injection system is emptied the first injector can be activated later than the second injector. The activation of the injectors can be here, for example, opening or closing of the injectors.

Alternatively or additionally, firstly all the injectors can be opened in particular in the case of filling. The injectors which are located closest to an inflow of the rail can then be closed first, for example as a function of a pressure signal.

Alternatively or additionally, in particular after a first filling phase, by means of brief injections and evaluation of the associated pressure drop it is possible to determine whether the filling was complete and whether the filling process is concluded.

In a further advantageous embodiment, the control device is configured to determine the activation response of the injectors additionally as a function of whether the rail is emptied or filled.

In particular, the activation sequence of the injectors can be determined as activation response as a function of whether the rail is emptied or filled. For example, when the rail is emptied a first injector can be activated before a second injector. When the rail is filled, the first injector can then be activated after the second injector.

At the start of the emptying of the rail, the latter is, for example, filled completely with coolant and all the injectors are closed. For the purpose of emptying, when the rail is inclined a first injector which is located at a relatively high point as a result of the inclination can then be opened before a second injector which is located at a relatively low point with respect thereto, in order to allow air to flow into the rail, to discharge the water completely from the rail.

On the other hand, at the start of the filling of the rail the latter is, for example, filled completely with air and all the injectors are opened. For the purpose of filling, when the rail is inclined, the second injector which is located at a relatively low point can then be closed before the first injector which is located at a relatively high point with respect thereto, in order to fill the rail with coolant.

In a further advantageous embodiment, the activation response of the injectors comprises the sequence and/or the points in time at which the injectors are activated.

In a further advantageous embodiment, the control device is configured to receive a pressure variable which is characteristic of the pressure in the rail. An activation time for at least one injector is determined as a function of the pressure variable, and the injector is activated at a specific activation time.

In particular, a pressure sensor which is present in any case can be utilized to receive the pressure profile as an additional input variable when the rail is filled. If there is air in the system, it can be detected in the pressure profile during the filling process owing to the difference in compressibility and viscosity between the air and the coolant. As soon as the coolant bears against the injectors, a rise in pressure can be observed, in response to which the corresponding injector can be activated. It can therefore be ensured that the coolant injection system is completely filled.

A second aspect of the invention relates to a coolant injection system for an internal combustion engine for a motor vehicle. The coolant injection system comprises a control device which has been described above, and at least two activatable injectors which can be controlled by the control device and have the purpose of introducing a coolant into an intake section of an internal combustion engine, and the injectors can be supplied with coolant by means of a common rail.

In one advantageous embodiment, the rail comprises a valve for sucking in fresh air. The control device is additionally configured here to control the valve. Alternatively, the valve can operate mechanically and open when there is an underpressure in the rail. For example, the valve is a filling valve or venting valve.

In particular, in the case of a valve which can be actuated electrically, the control device is configured to open the valve when the rail is emptied, so that the rail is filled with fresh air instead of with air from the internal combustion engine.

Alternatively or additionally, the control device is configured to close the valve when the rail is filled, so that air which is located in the coolant injection system can exit the coolant injection system exclusively via opened injectors.

In particular, a control sequence of the coolant injection system is possible in which in a first step the valve is opened when the rail is emptied so that the rail is filled with fresh air instead of with air from the internal combustion engine. In a second step, the valve is closed and the injectors are opened. The air located in the system is used to push out the remaining coolant from the injectors and into the intake system. In a third step, the rail and the parts of the coolant injection device which are to be ventilated are then ventilated with fresh air again in that air is sucked into the system with the injectors closed and the valve opened.

This control sequence is based on the realization that it can be advantageous that no tank venting gases, combustion gases or blowby gases can pass from the intake system into the coolant system.

A third aspect of the invention relates to a method for controlling a coolant injection system for an internal combustion engine of a motor vehicle, wherein the coolant injection system comprises at least two activatable injectors for introducing coolant into the internal combustion engine, and the injectors can be supplied with coolant by means of a common rail.

One step of the method is to receive an inclination variable which is characteristic of an inclination of the rail.

A further step of the method is to determine an activation response for the injectors as a function of the inclination variable.

A final step of the method is to activate the injectors with the determined activation response in order to empty or fill the rail.

The above statements relating to the inventive control device according to the first aspect of the invention correspondingly also apply to the inventive system according to the second aspect of the invention, and also to the inventive method according to the third aspect of the invention. At this point, and in the patent claims, advantageous exemplary embodiments of the inventive system which have not been explicitly described and of the method according to the invention correspond to the advantageous exemplary embodiments of the inventive control device which have been described above or described in the patent claims.

The invention will be described below on the basis of an exemplary embodiment and with the aid of the appended drawings.

DETAILED DESCRIPTION OF THE DRAWINGS

Figure 1:
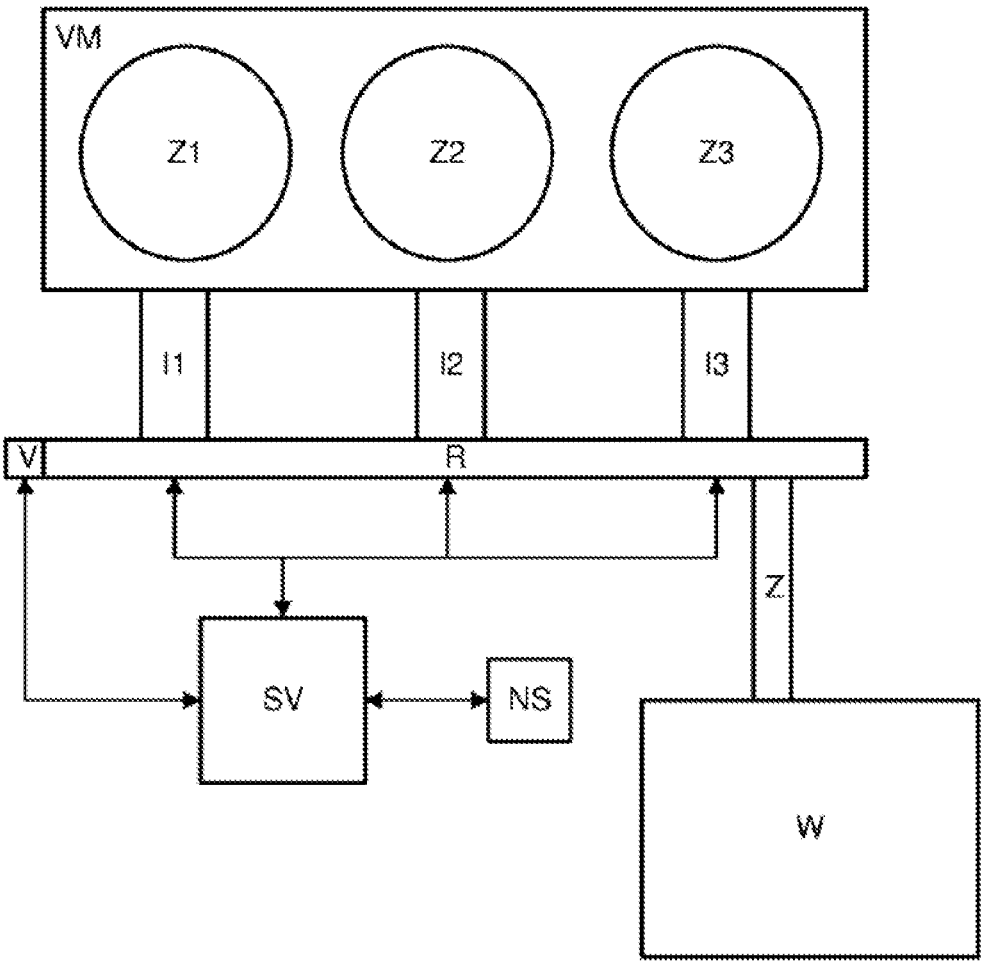
FIG. 1 shows an exemplary embodiment of a coolant injection system according to the invention.

FIG. 1 shows an internal combustion engine VM of a motor vehicle. The internal combustion engine is connected to a coolant injection system, wherein the coolant injection system comprises three activatable injectors I1, I2, I3 which can be controlled by a control device SV and have the purpose of introducing a coolant into the internal combustion engine VM. In particular, the injectors I1, I2, I3 are connected here to the internal combustion engine VM in such a way that each injector I1, I2, I3 is assigned a cylinder Z1, Z2, Z3 of the internal combustion engine VM.

The injectors I1, I2, I3 can be supplied with coolant by means of a common rail R, wherein the coolant can be pumped out of a coolant tank W, for example, through an inflow Z.

The control device SV is also coupled to an inclination sensor NS which determines an inclination variable which is characteristic of an inclination of the rail R, such as, for example, the inclination of the motor vehicle in the longitudinal direction and transverse direction. Furthermore, the control device SV is coupled to a valve V which forms part of the rail R and has the purpose of sucking in fresh air.

Figure 2:
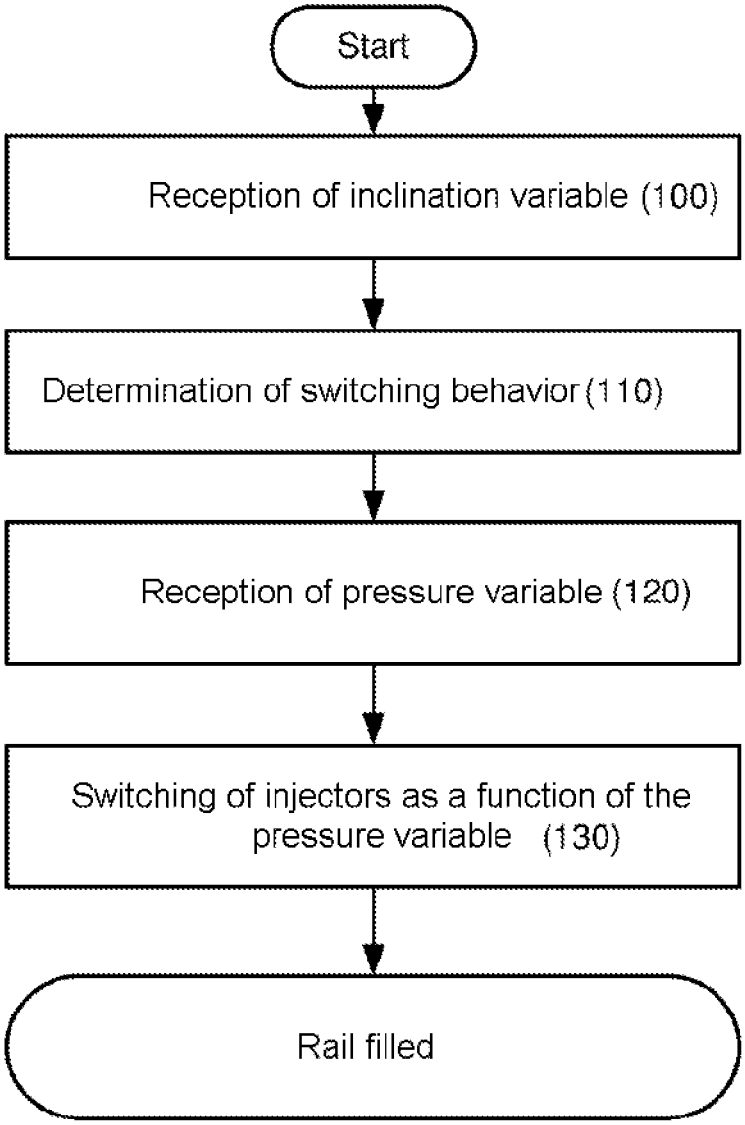
FIG. 2 shows an exemplary embodiment of a method according to the invention for controlling the coolant injection system.

FIG. 2 shows an exemplary embodiment of a method according to the invention for controlling the coolant injection system.

At the start of the method sequence, the rail R is completely emptied here and there is therefore no coolant in the rail R. All the injectors I1, I2, I3 are opened so that when any possible filling of the rail R with coolant occurs the air which is located in the rail R can escape through the opened injectors I1, I2, I3.

In step 100, the control device SV receives an inclination variable which is characteristic of an inclination of the rail R. This may be, for example, an inclination of the motor vehicle in the longitudinal direction of the vehicle, which is determined by an inclination sensor NS.

In the following step 110, the control device SV determines an activation response for the injectors I1, I2, I3 as a function of the inclination variable. The activation response comprises here, in particular, the sequence in which the injectors I1, I2, I3 are to be activated.

For example, the control device SV can select here an activation response for the injectors I1, I2, I3 from a set of at least two predetermined activation responses for the injectors I1, I2, I3. These predetermined activation responses can be determined empirically, for example during the development of the coolant injection system.

In addition, during the determination of the activation response of the injectors I1, I2, I3 the control device SV can also take into account whether the R is emptied or filled.

For example, the control device SV is configured to determine the activation response for the injectors I1, I2, I3 in such a way that a first injector I1 which is located at a relatively high point owing to the inclination, is activated later when the rail R is filled then a second injector I2 which is located at a relatively low point with respect thereto owing to the inclination.

During the filling process of the rail R, the control device can receive, in step 120, a pressure variable which is characteristic of the pressure in the rail R. Depending on the pressure variable, an activation time is determined for the injector I1, I2, I3 which is next according to the determined activation response, and the next injector I1, I2, I3 is closed in step 130 at the specific activation time as soon as the rise in pressure which is characteristic of the time when coolant is present at the injectors I1, I2, I3 can be observed.

After the closing of the last injector I1, I2, I3, the rail can be completely filled.

Figure 3:
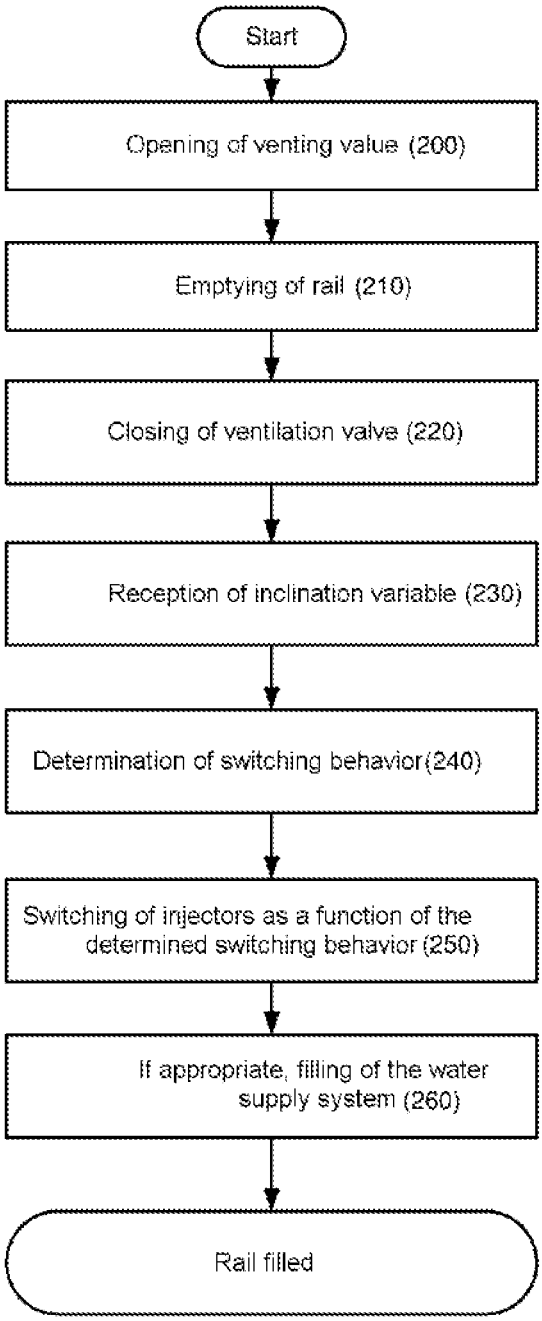
FIG. 3 shows a further exemplary embodiment of a method according to the invention for controlling the coolant injection system.

FIG. 3 shows a further exemplary embodiment of a method according to the invention for controlling the coolant injection system.

For the start of the method sequence, the rail R is completely filled with coolant here. All the injectors I1, I2, I3 are closed so that cooling fluid is not introduced into the internal combustion engine VM.

In order to empty the rail R, the valve V which forms part of the rail R is opened by the control device SV in step 200.

In the following step 210, the rail R and part of the coolant supply system are emptied in that the coolant which is located therein is pumped into the coolant tank W. Owing to the open valve V the corresponding volume is filled with fresh air here.

As soon as the rail R is completely emptied, in step 220 the valve V is closed by the control device SV.

In step 230, the control device SV receives an inclination variable which is characteristic of an inclination of the rail R. This may be, for example, an inclination of the motor vehicle in the longitudinal direction of the vehicle, which is determined by the control device SV itself.

In the following step 240, the control device SV determines, as a function of the inclination variable, an activation response for the injectors I1, I2, I3. The activation response comprises here, in particular, the sequence in which the injectors I1, I2, I3 are to be activated, and the time at which the injectors I1, I2, I3 are to be activated.

In step 250, the injectors I1, I2, I3 are then activated in the determined sequence and at the determined times, and the air in the system is used to push out the coolant from the injectors and into the intake system so that after the method is concluded the injectors and the rail are filled with fresh air.

If necessary, in the following step 260 the coolant supply system is again filled with fresh air up to the provided proportion of the volume when the injectors are closed and the valve is opened.

What is claimed is:

1. A device for a coolant injection system for an internal combustion engine of a motor vehicle, wherein the coolant injection system comprises at least two activatable injectors which are controllable so as to introduce a coolant into the internal combustion engine, and a common rail by which the injectors are supplied with coolant, wherein the device comprises:

a control device configured to:

receive an inclination variable characteristic of an inclination of the rail, determine an activation response of the injectors as a function of the inclination variable, and activate the injectors using the determined activation response in order to empty or fill the rail.

2. The device according to claim 1, wherein the control device is further configured to:

select the activation response of the injectors from a set of at least two predetermined activation responses for the injectors as a function of the inclination variable.

3. The device according to claim 1, wherein the control device is further configured to:

determine the activation response of the injectors as a function of the inclination variable such that a first injector which is located at a relatively high point owing to the inclination is activated earlier when the rail empties than a second injector which is located at a relatively low point with respect thereto owing to the inclination.

4. The device according to claim 3, wherein the control device is further configured to:

determine the activation response of the injectors as a function of the inclination variable, such that a first injector which is located at a relatively high point owing to the inclination is activated later when the rail is filled than a second injector which is located at a relatively low point with respect thereto owing to the inclination.

5. The device according to claim 1, wherein the control device is further configured to:

determine the activation response of the injectors as a function of the inclination variable, such that a first injector which is located at a relatively high point owing to the inclination is activated later when the rail is filled than a second injector which is located at a relatively low point with respect thereto owing to the inclination.

6. The device according to claim 1, wherein the control device is further configured to:

determine the activation response of the injectors additionally as a function of whether the rail is emptied or filled.

7. The device according to claim 1, wherein the control device is further configured to:

determine the activation response of the injectors additionally as a function of a distance of the respective injector from a rail inflow and/or from a geometric configuration of the rail.

8. The device according to claim 1, wherein the activation response of the injectors comprises a sequence and/or points in time at which the injectors are activated.

9. The device according to claim 1, wherein the control device is further configured to:

receive a pressure variable which is characteristic of pressure in the rail, determine an activation time for at least one injector as a function of the pressure variable, and activate the injector at the determined activation time.

10. A coolant injection system for an internal combustion engine for a motor vehicle, comprising:

at least two activatable injectors which are controlled so as to introduce a coolant into an intake section of the internal combustion engine;

a common rail by which the injectors are supplied with coolant; and a control device configured to:

receive an inclination variable characteristic of an inclination of the rail, determine an activation response of the injectors as a function of the inclination variable, and activate the injectors using the determined activation response in order to empty or fill the rail.

11. The coolant injection system according to claim 10, wherein the rail comprises a valve for sucking in fresh air.

12. A method for controlling a coolant injection system for an internal combustion engine of a motor vehicle, wherein the coolant injection system comprises at least two activatable injectors for introducing coolant into the internal combustion engine, wherein the injectors are supplied with coolant via a common rail, the method comprising the steps of:

receiving an inclination variable which is characteristic of an inclination of the rail;

determining an activation response for the injectors as a function of the inclination variable, and activating the injectors with the determined activation response in order to empty or fill the rail.

* * * * *